US005103732A

United States Patent [19]

Wells et al.

[11] Patent Number: 5,103,732

[45] Date of Patent: Apr. 14, 1992

[54] DOCTOR BLADE HEAD ASSEMBLY AND PRINTING APPARATUS THEREWITH

[75] Inventors: Robert R. Wells, Phoenix; Stephen M. Raver, Baltimore, both of Md.; Glenn D. Heisey, Lititz, Pa.

[73] Assignee: Ward Holding Company, Inc., Wilmington, Del.

[21] Appl. No.: 655,653

[22] Filed: Feb. 14, 1991

[51] Int. Cl.[5] ..... B41F 31/00; B41F 1/34; B05D 3/12; B05C 11/02

[52] U.S. Cl. ..... 101/480; 101/350; 101/157; 101/148; 101/167; 427/356; 118/126; 118/259; 118/410

[58] Field of Search ..... 101/119, 157, 350, 363, 101/364, 366, 148, 207, 208, 210, 169, 480, 167, 120, 123; 118/259, 261, 410, 413, 419, 126, DIG. 11; 427/356

[56] References Cited

U.S. PATENT DOCUMENTS

| | | | |
|---|---|---|---|
| 3,116,688 | 1/1964 | Ward, Jr. et al. | 101/350 |
| 3,630,146 | 12/1971 | Shields | 101/351 |
| 3,793,952 | 2/1974 | Neumann | 101/157 |
| 3,878,780 | 4/1975 | Lotte | 101/119 |
| 3,930,445 | 1/1976 | Jaffa | 101/120 |
| 4,169,425 | 10/1979 | Wohrle | 118/665 |
| 4,192,709 | 3/1980 | Dunlap | 162/111 |
| 4,351,264 | 9/1982 | Flaum et al. | 118/203 |
| 4,396,648 | 8/1983 | Holt | 427/356 |
| 4,440,809 | 4/1984 | Vreeland | 427/356 |
| 4,461,211 | 7/1984 | Wesselmann et al. | 101/366 |
| 4,590,855 | 5/1986 | Schommer et al. | 101/157 |
| 4,665,859 | 5/1987 | Dunlap et al. | 118/126 |
| 4,821,672 | 4/1989 | Bruno | 118/261 |
| 4,839,201 | 6/1989 | Rantanen | 427/355 |
| 5,003,876 | 4/1991 | Harrison | 101/350 |

*Primary Examiner*—Edgar S. Burr
*Assistant Examiner*—Eric P. Raciti
*Attorney, Agent, or Firm*—Boyce C. Dent; Edward D. C. Bartlett

[57] ABSTRACT

A doctor blade head assembly, particularly for use in a flexographic printing press, has a head body pivoted to a support frame with an inflatable air tube disposed therebetween. The air tube extends along a channel having a bottom formed with spaced apart raised portions which cause the air tube to bulge out at these locations. In this way the air tube essentially only presses against the head body at these spaced apart locations, for example at the center and adjacent the ends, which reduces the tendency of the head body to bend along its length. This provides a more uniform ink film on the ink roll being inked by the doctor blade head assembly. End seal arrangements at the ends of the head body each include a resilient block seal and a resilient pad seal with which greased edge portions of the doctor blades slidably engage. The doctor blades overhang the ends of the ink roll, and an ink outlet passageway extends through each end seal arrangement independently of the seals.

28 Claims, 9 Drawing Sheets

DOCTOR BLADE HEAD ASSEMBLY AND PRINTING APPARATUS THEREWITH

FIELD OF THE INVENTION

This invention relates to doctor blade heads in general, and also to printing apparatus employing a doctor blade head in the inking of an ink roll.

BACKGROUND OF THE INVENTION

Doctor blade heads may have one, two or more doctor blades. With two or/more doctor blades, an ink reservoir can be defined between the blades. Some doctor blades are employed to seal against an ink roll to form the bottom of an ink reservoir, while other doctor blades are used for doctoring the thickness of the ink film on the ink roll, and such blades may be orientated as so called reverse angle doctor blades.

In printing, various configurations of doctor blade heads have been employed, including a head having two doctor blades with the ink reservoir contained therebetween, one doctor blade forming the bottom of the reservoir and the other being a reverse angle blade for doctoring the ink film.

Doctor blade heads are employed in flexographic printing apparatus and individual machine sections.

In Ward, Jr. et al U.S. Pat. No. 3,116,688, a doctor blade head is disclosed in which an inflatable air tube is employed to flex a doctor blade against an ink fountain roll. An air tube is disclosed in pending U.S. patent application Ser. No. 310,065 (subsequently granted as Harrison et al U.S. Pat. No. 5,003,876) to pivot a doctor blade head against an anilox roll.

An air tube has been found to provide good control over the pressure by which the blade or blades of a doctor blade head can be pressed against an ink roll.

It is also known to provide end sealing arrangements at the ends of any ink reservoir in a doctor blade head. Examples of such end sealing arrangements are disclosed in Ward, Jr. et al and Harrison et al referred to above.

However, with the desire for higher quality printing on containers, particularly corrugated paperboard container blanks printed by flexographic printing presses, the performance of existing doctor blade heads has become more critical.

SUMMARY OF THE INVENTION

The present invention is based upon the realization that an inflatable air tube has a tendency to slightly bend a doctor blade head along its length, with consequential variation in the thickness of the ink film applied to the ink roll.

With doctor blade heads having a length of the order of 100 inches, use of an inflatable air tube in contact with the length of such heads has been found to cause a deflection midway along the length of 20 thousandths of an inch.

The present invention is also based upon the realization that particles in ink, particularly in water based flexographic ink, tend to abrade any surface portions of the doctor blades where these surface portions seal against a resilient seal It appears that these particles, e.g. pigment particles, get trapped between the doctor blades and seals, and then as the blades flex abrasion occurs.

It has been realized that unwanted ink leakage and/or flow can occur due to both the above bending of the doctor blade head, and the above abrasion of the doctor blade surface, either separately or in combination. This in turn affects the quality or efficiency of the printing operation, particularly as higher quality printing is pursued.

It is an object of the present invention to provide an improved doctor blade head for higher quality printing, particularly with flexographic printing.

According to one aspect of the present invention, there is provided a doctor blade head assembly having a head body with at least one doctor blade mounted thereon, the doctor blade extending in a lengthwise direction along the head body. A support frame on which the head body is movably mounted. An inflatable air tube disposed between the support frame and the head body, and extending in said lengthwise direction, the air tube urging the head body away from the support frame when the air tube is inflated. The air tube has a plurality of bulges spaced apart along said lengthwise direction.

Preferably, the air tube is supported in the support frame with the air tube essentially only acting upon the head body via the bulges. The spacing of these bulges, i.e. the locations where the air tube applies forces to the head body, are preselected to mitigate the head body bending under the action on it of the inflated air tube.

Although these bulges locate force centers, the inflated air tube may be spaced from or lightly engage the head body between the bulges.

The support frame may carry a plurality of raised portions acting upon the air tube to form the bulges, these raised portions being rigidly secured to the support frame either by being integrally formed or rigidly attached. The raised portions can conveniently be formed by riser plates secured to the bottom of a channel at predetermined locations. The riser plates may have predetermined lengths, and shapes, to create the bulges with predetermined lengths and extent of protrusion.

A flexible retainer may be mounted on the support frame and at least partially cover the air tube, the flexible retainer being sandwiched between the air tube and the head body when the air tube is inflated.

The air tube may be supported on one or more raised portions having curved convex surfaces.

Preferably, there is a plurality of spaced apart hinged connections between the head body and the support frame with each of the air tube bulges being disposed between two adjacent hinge connections.

The air tube may be supported on a shallowly curved surface extending substantially the full length of the head body, for example in the bottom of a tube support channel.

According to another aspect of the invention, there is provided a doctor blade head assembly wherein a head body has two doctor blades mounted thereon and defining a reservoir space therebetween, the head body being pivotally attached to a frame structure to pivot about an axis parallel to the lengthwise direction of the head body. End plates are mounted on the head body and close the reservoir space at opposite ends thereof. An inlet in the head body introduces liquid into the reservoir space, and an outlet passageway extends through each end plate for allowing exit of the liquid from the reservoir space.

According to yet another aspect of the invention, there is provided a doctor blade head assembly including a head body having two doctor blades mounted thereon, the doctor blades converging towards each other transversely to a lengthwise direction of the head body. Free edges of the doctor blades in the lengthwise direction are spaced apart and have end portions smeared with grease. Seals comprising blocks of resilient material are located at opposite ends in the lengthwise direction of the head body, the greased end portions of the free edges slidably engaging against opposite side walls of these blocks.

According to yet a further aspect of the present invention, there is provided a printing apparatus comprising a machine frame, an anilox roll rotatably supported in and extending in an axial direction across said machine frame, a doctor blade head body having at least one doctor blade mounted thereon, this doctor blade extending in the axial direction along the head body, a support frame on which the head body is movably mounted, the support frame being supported in the machine frame, an inflatable air tube operative between the support frame and the head body, this air tube urging the head body towards the anilox roll when the air tube is inflated, and the air tube having a plurality of predetermined bulges spaced apart in the axial direction. End seal arrangements may be provided at the ends of the doctor blade or blades, with the end transverse edges of each blade being sealed outboard from the ends of the head body, preferably a layer of grease being disposed between each of such end edges and a seal pad. An ink outlet passageway may extend through each end seal arrangement independently of the locations at which the blade edges are sealed.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings, in which in different Figures like reference characters indicate like parts.

DETAILED DESCRIPTION OF THE PREFERRED EMBODIMENT

Figure 1:
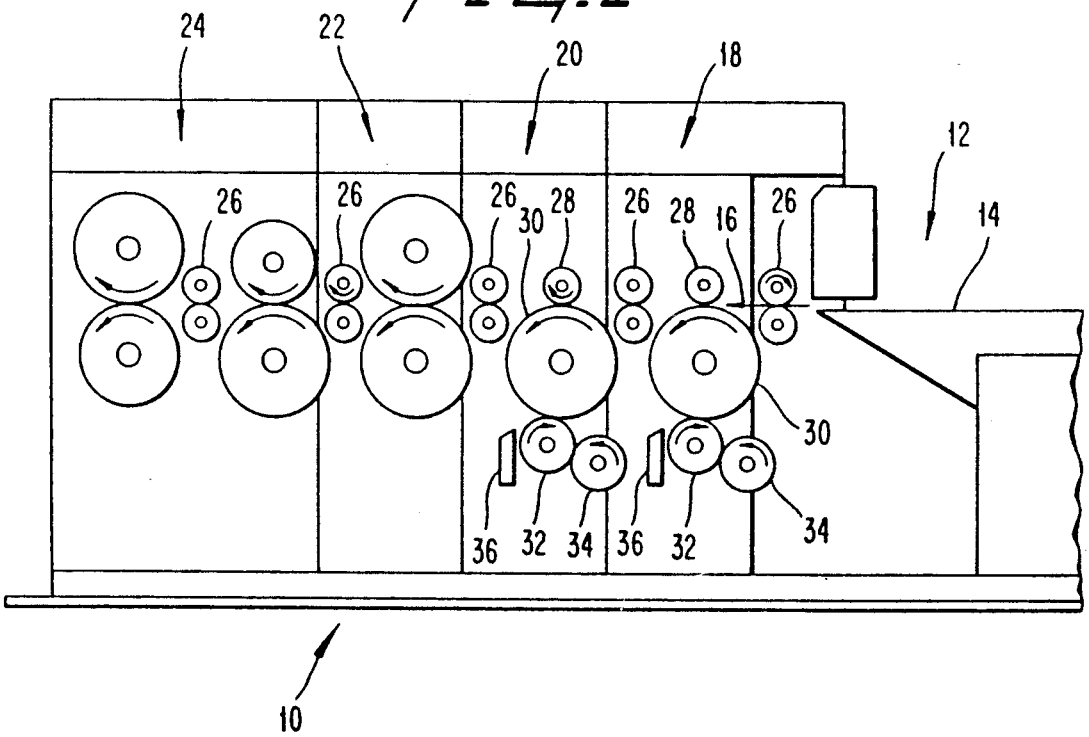
FIG. 1 is a simplified diagrammatic side elevational view of a container blank processing machine having two printing sections with doctor blade heads according to the invention.

The invention is shown in relation to FIGS. 1 to 4 incorporated in a dual inking system in which either a wipe roll inking system or a double doctor blade inking system can be used in the alternative to provide, at choice, inking characteristics of either inking system. A preferred use of this dual inking system incorporating the present invention is illustrated in FIG. 1 in which a flexographic printer, die-cutter, creaser and slotter machine incorporates two printing sections each having the dual inking system of FIG. 2.

Figure 10:
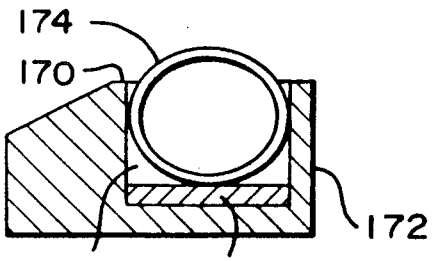
FIG. 10 is a simplified section on the line 10—10 of FIG. 9.
Figure 11:
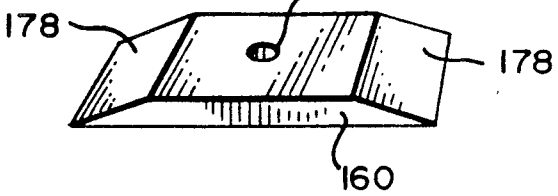
FIG. 11 is a perspective view of one of the air tube supports of FIG. 9.

The invention is, however, generally applicable to doctor blade heads, and preferred embodiments of features of the present invention are illustrated in FIGS. 5 to 18. The preferred embodiment of an air tube mounting arrangement is shown in FIGS. 9, 10 and 11, and the preferred embodiment of an end seal arrangement is shown in FIGS. 13 and 18.

In FIG. 1, the flexographic printing machine 10 has a feed section 12 for supporting a stack of container blanks on a platform 14 and for feeding the blanks one at a time from the bottom of the stack in the downstream direction 16 of the machine. Each blank then passes successively through a first printing section 18, a second printing section 20, a die-cutter section 22, and a yoked creaser and slotter section 24. The various rolls in these sections rotate in the directions indicated by arrows to feed the container blanks through the machine, pairs of feed rolls 26 feeding the blanks from one section to the next. Each printing section 18, 20 has an impression roll 28 cooperating with a print cylinder 30 carrying a printing plate, an anilox roll 32 for inking the printing plate, and a wipe roll 34 and a doctor blade head 36 on opposite sides of the anilox roll 32 for forming an ink fountain with the anilox roll. In printing sections 18, 20, each wipe roll 34 is shown in engagement with its respective anilox roll 32 and each doctor blade head 36 is shown spaced a short distance from the respective anilox roll 32. Thus, each printing section 18, 20 is shown in FIG. 1 with the wipe roll inking system operative and the doctor blade inking system disengaged. Either or both printing sections 18, 20 can be changed to render the wipe roll inking system inoperative and engage the doctor blade inking system. It will be noted that the dual inking systems, each comprising one wipe roll 34, one doctor blade head assembly 36, and one anilox roll 32, are disposed below the respective print cylinder 30 with the anilox roll 32 between the wipe roll 34 and the doctor blade head 36. In this way, an ink fountain can be established on either side of the anilox roll, this advantageously being either an external fountain with the wipe roll inking system or an internal fountain with the doctor blade head inking system.

One of the printing sections 18, 20 can be operated in the wipe roll mode of inking and the other in the doctor blade mode of inking. Alternatively, both printing sections 18, 20 can be operated in the wipe roll mode, or both in the doctor blade mode. Further, there could be only one printing section, or more than two printing sections, e.g. three sections to accommodate three primary colors.

Figure 2:
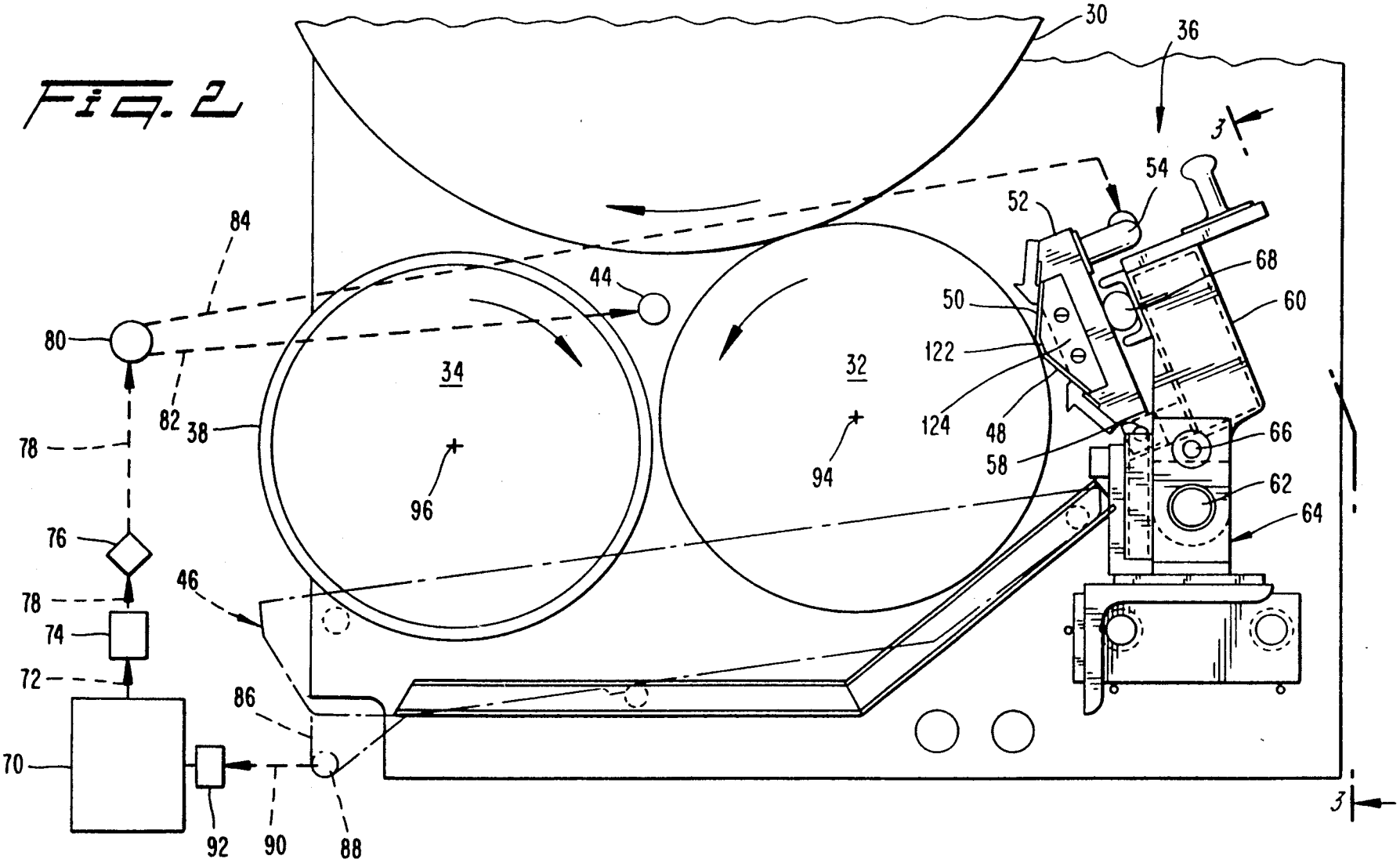
FIG. 2 is a diagrammatic side view, including a schematic indication in broken lines of the ink flow, of a portion of either of the printing sections of the machine of FIG. 1, but viewed from the opposite side to FIG. 1.

FIG. 2 illustrates the lower portion of either printing section 18 or 20, but from the opposite side of the machine 10 to that shown in FIG. 1. For ease of understanding, some parts have been omitted, some illustrated in broken lines, and a resilient cover 38 of the wipe roll 34 shown in section. The print cylinder 30, anilox roll 32, and wipe roll 34 rotate in the directions of their arrows.

The wipe roll 34 is shown in an inoperative position in FIG. 2 spaced a short distance from the anilox roll 32. The wipe roll 34 is journalled in a pivotal frame and can be moved into nipping contact with the anilox roll 32 by a pair of air cylinders. Similarly, the anilox roll 32 is journalled in another pivotal frame and moved into adjustable nipping contact with the printing plate of the print cylinder 30 by another pair of air cylinders. When the wipe roll inking system is operative, the wipe roll 34 engages the anilox roll 32, and ink flows out of pipe outlet 44 into the trough of the upper nip between the wipe and anilox rolls 34, 32. This forms an ink fountain between these rolls with ink flowing out of each end of the upper nip trough and falling into a drain tray or ink pan 46 (shown in broken lines) located below both the wipe roll 34 and the anilox roll 32 and sloping downwards to the left in FIG. 2. When the wipe roll inking system, after use, is rendered inoperative, inter alia, the ink flow from outlet 44 is stopped, the rolls cleaned by washing, and the wipe roll 34 pivoted away from the anilox 32 to the spaced position shown in FIG. 2.

The doctor blade head assembly 36 has, mounted on a doctor blade head body 52, a lower forwardly directed doctor blade 48 and an upper reverse angle doctor blade 50 As shown in FIG. 2, the doctor blades 48, 50 are in engagement with the anilox roll 32 and the doctor blade head assembly 36 is in the operative position. In this operative position, ink is supplied to the top of the doctor blade body 52 via an inlet pipe 54, the ink filling an open, outwardly facing reservoir cavity formed between the body 52 and the doctor blades 48, 50. The surface of the anilox roll 32 closes the open side of this ink reservoir cavity (see also FIG. 4). Outlet pipes 56 (see FIGS. 3 and 4) at each end of the body 52 discharge excess ink from this ink reservoir cavity into the drain tray 46. The doctor blade head body 52 is pivotally mounted by a pivot pin 58 at each end on a frame 60. The frame 60 is pivotally mounted by a pair of pivots 62 (see also FIG. 3) to a portion 64 of the main frame structure of the respective printing section 18, 20 of the machine 10. The frame 60 can be pivoted to the right (i.e. clockwise in FIG. 2) for maintenance on the doctor blade body 52, doctor blades 48, 50 etc. In the position shown, the frame 60 is locked at each end to the main frame portion 64 by a removable locking pin 66. An air tube 68, operative between the locked frame 60 and the pivotal doctor blade head body 52, resiliently urges the doctor blades 50, 48 into controlled contact with the surface of the anilox roll 32. The mounting of the air tube 68 according to the invention will be described in greater detail later.

Both inking systems, i.e. wipe roll and doctor blade, share the same ink circulation system. This comprises an ink supply 70, e.g. a drum or bucket of ink, an ink supply pipe 72 inserted in the ink supply 70 and connected to the inlet of an ink supply pump 74, and a filter 76 connected by piping 78 between the outlet of the supply pump 74 and a two-way selective distribution valve 80, i.e. the valve 80 has one inlet and two alternative outlets. One outlet of the valve 80 is connected by piping 82 to the pipe outlet 44 above the nip of the wipe roll 34 and anilox roll 32. The other outlet of valve 80 is connected via piping 84 to the inlet pipe 54 of the doctor blade body 52. Ink is thus supplied by the pump 74 to either the wipe roll 34 or the doctor blade head assembly 36 depending upon the position of the valve 80. In either case, excess ink flows into the drain tray 46 and drains to two space-apart side sumps 86 therein (only one sump can be seen in FIG. 2), an outlet 88 of each sump 86 being connected by return piping 90 to the ink supply 70 via an ink return pump 92. Thus, whichever inking system is selected and in operation, the ink fountain of that system with the anilox roll 32 is kept filled to a certain level with excess ink supplied by the supply pump 74 being returned to the ink supply container 70 by the ink return pump 92. The return pump 92 preferably is operated at an effective pumping rate greater than that of the supply pump 74.

Figure 3:
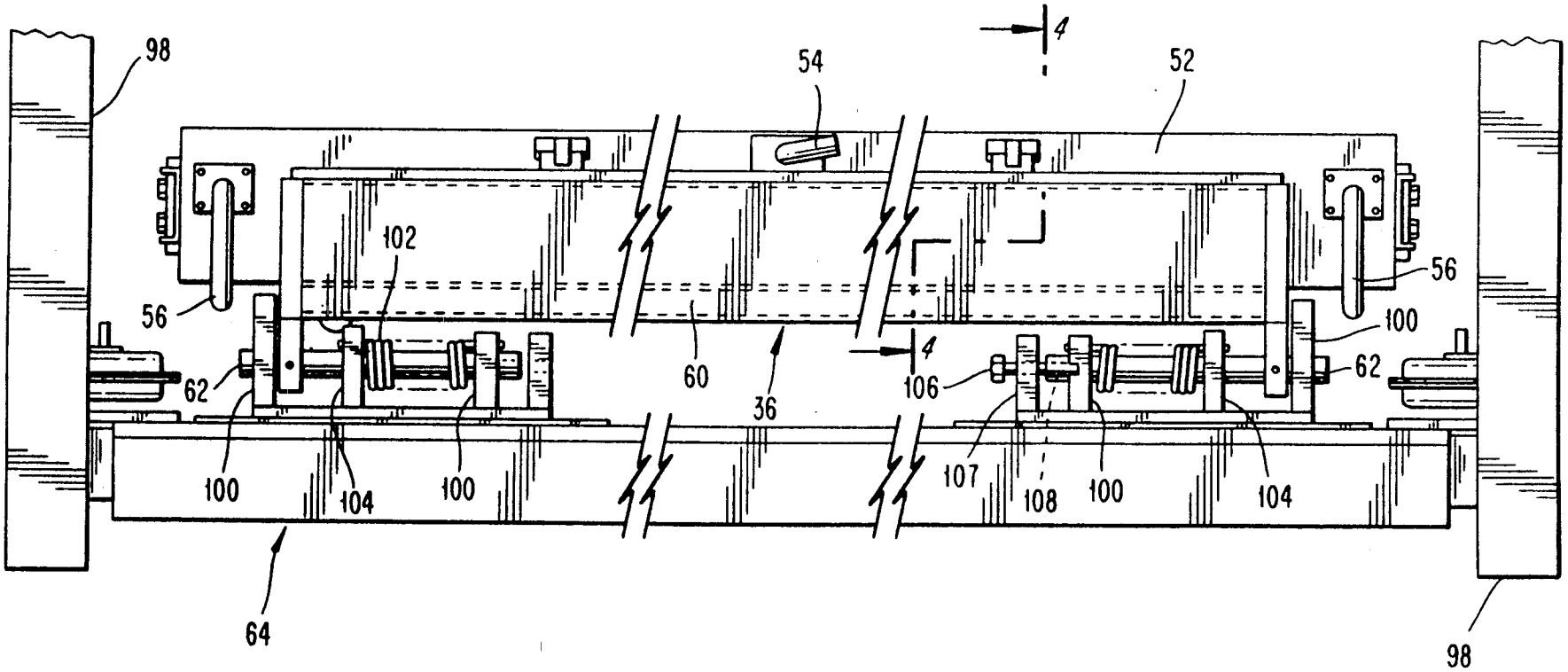
FIG. 3 is a view generally on the line 3—3 of FIG. 2 of a pivotal doctor blade head assembly, some parts being omitted for simplicity.

FIG. 3 shows a somewhat simplified view generally on the angled line 3—3 in FIG. 2 of the doctor blade head assembly 36 mounted by the pair of elongate pivot pins 62 to the main frame structure portion 64 between side frame plates 98. The ink inlet pipe 54 enters the top of the body 52 centrally of the length thereof. The two ink outlet pipes 56 leave the ends of the body 52 at locations below the location of entry of the inlet pipe 54 into the body 52. The ink outlets may be lower than shown, and preferably the sum of the areas of the two ink outlets is less than the area of the ink inlet 54. The pivot pins 62 of the frame 60 are pivoted at each end in flanges 100 extending upwardly from the machine frame portion 64. A coil spring 102 encircles each pivot 62 with one end of the spring being secured to one of the flanges 100 and the other end secured to a collar 104 non-rotatably fixed on that pivot pin. When the locking pin 66 (see FIG. 2) is removed from each end of the doctor blade assembly 36 and the assembly 36 pivoted about the pivots 62 away from the anilox roll (i.e. clockwise in FIG. 2), the springs 102 are torsionally tensioned to partially counterbalance the weight of the whole assembly 36. An adjusting screw 106 is threaded through another flange 107 extending upwardly from the machine frame portion 64 of FIG. 3, the end of this screw 106 being rotatably captured in a counterbore 108 in the inner end of the righthand pivot pin 62. Rotational adjustment of the screw 106 moves the righthand pivot pin 62 axially relative to the flanges 100 in which it is journalled. Both pivot pins 62 are movable axially relative to the flanges 100. In this way, the axial position of the doctor blade assembly 36 can be adjusted axially relative to the anilox roll. Preferably, an operator rotates the adjusting screw 106 a partial turn each day to more evenly distribute any wear between the doctor blades 48, 50 and the surface of the anilox roll 32.

Figure 4:
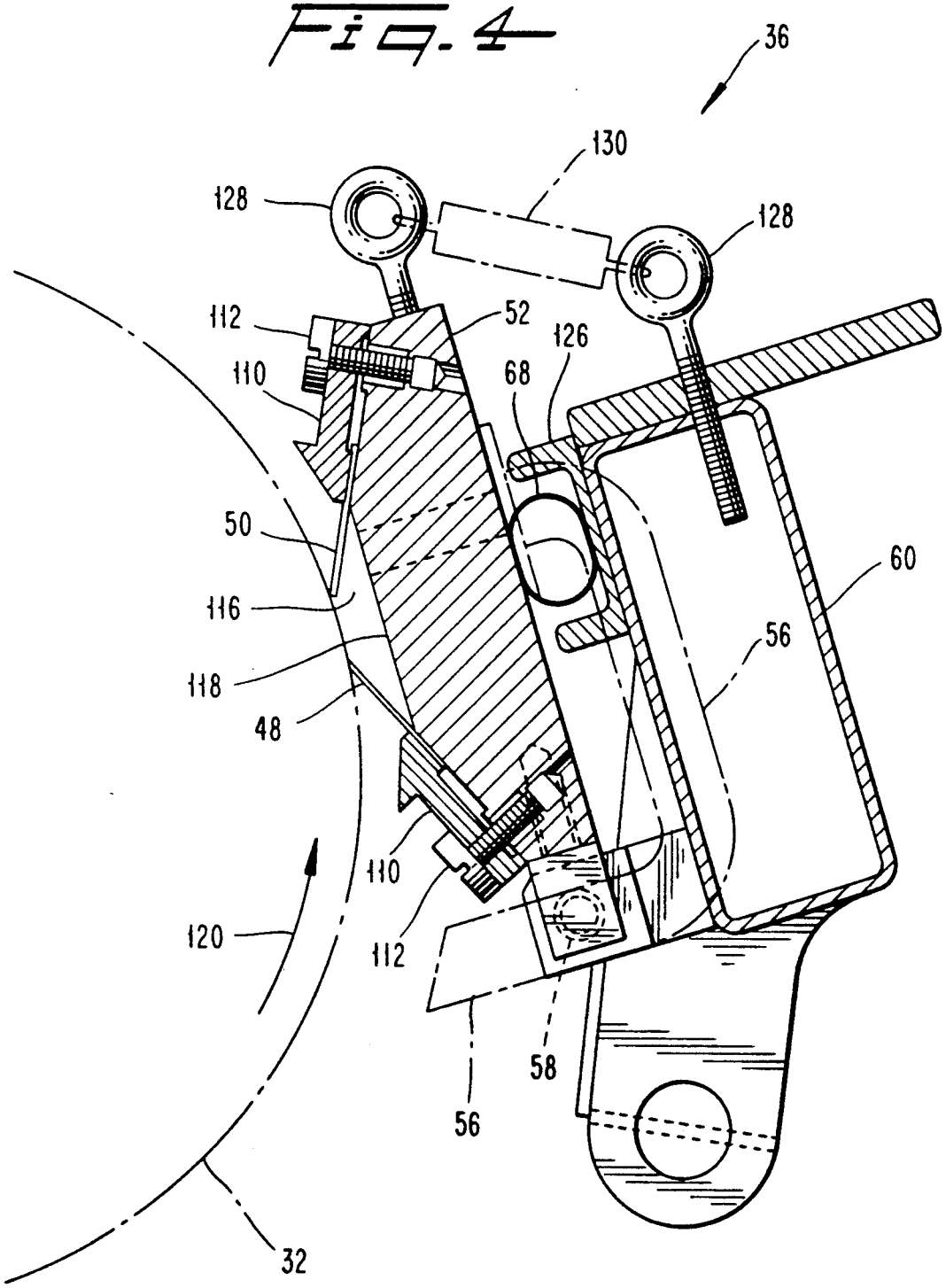
FIG. 4 is a stepped vertical section through the doctor blade head assembly on the line 4—4 in FIG. 3.

FIG. 4 shows a vertical section through the doctor blade assembly 36 on the stepped line 4—4 in FIG. 3. The flexible doctor blades 48, 50 are clamped in adjusted position to the body 52 by backing plates 110 and clamping screws 112. An internal ink reservoir or fountain 116 is defined in the doctor blade assembly 36 between the doctor blades 48, 50, a face 118 of the body 52, and a portion of the surface of the anilox roll 32. In the direction of rotation of the anilox roll 32 shown by the arrow 120, the lower doctor blade 48 functions as an ink retaining blade forming the bottom of the fountain 116; and the upper doctor blade 50 functions as a reverse angle doctor blade to scrape the inked surface of the anilox roll 32 and doctor the thickness of the ink film conveyed by the surface of the anilox roll to the printing plate on the print cylinder 30 (FIG. 2). The doctor blades 48, 50 may have the same flexibility; preferably, however, the upper blade 50 extends as a short stiff blade for doctoring, and the lower blade 48 extends further, is more flexible and is flexed upwardly against the surface of the anilox roll 32 for improved sealing therewith. Improved sealing of the lower blade 48 can be obtained by allowing this blade to flex sufficiently that its outer surface at its free edge tangentially wipes against the anilox roll surface.

The lateral ends of the fountain 116 are sealed by resilient rubber gaskets 122 (see FIG. 2) which seal against the two doctor blades 48, 50, the cylindrical surface of the anilox roll 32, and the flat ends of the body 52, the gaskets 122 being clamped in position by end plates 124 (only one of which can be seen in FIG. 2). However, a preferred manner of sealing is described later.

The air tube 68 is located in a channel 126 on the frame 60. Eye bolts 128 are screwed into the tops of the body 52 and the frame 60. A coil spring 130 has its ends connected to the eyes of the bolts 128 and is under tension to resiliently urge the body 52 to pivot clockwise (in FIG. 4) about its pivot pins 58 towards the frame 60. Thus, when compressed air is introduced into the air tube 68, the expansion of the tube 68 overcomes the, bias of the spring 130 and rotates the body 52 counterclockwise about the pivot pins 58 to urge the free ends of the doctor blades 48, 50 against the anilox roll 32. The degree of inflation of the tube 68 in general determines the pressure with which the blades 48, 50 are pressed against the anilox roll 32. Upon allowing the tube 68 to deflate by exhausting the compressed air therefrom, the spring 130 will function to pivot the head 52 clockwise and space the ends of the doctor blades 48, 50 away from and out of contact with the surface of the anilox roll 32; thus the default position of the doctor blade assembly 36 is the inoperative position with the doctor blades 48, 50 spaced from the anilox roll 32.

Figure 5:
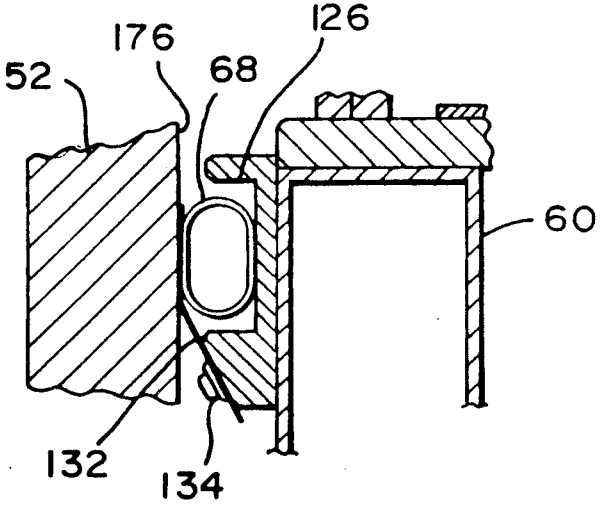
FIG. 5 is a sectional view, similar to FIG. 4, but of only a portion of the doctor blade head assembly and showing an air tube retainer.

FIG. 5 shows a portion of FIG. 4 with a preferred retainer 132 holding the air tube 68 in the channel 126. The retainer 132 is a thin flexible plastic strip, extending the full length of the channel 126, and secured to the lower wall of the channel 126 by a plurality of screws 134. Widthwise the retainer strip 132 extends upwardly in cantilever fashion, and flexes towards the channel 126 by being sandwiched between the outer protruding surface of the air tube 68 and the back of the doctor blade head body 52. The retainer strip 132 flexes readily during the expanding and contracting of the air tube. When the doctor blade body 52 pivots away from the frame 60, the flexible strip 132 retains the air tube 68 in position. Also, the strip retainer 132 eliminates any tendency for wear and abrasion between the air tube and the body 52 during operation of the doctor blade head.

Figure 6:
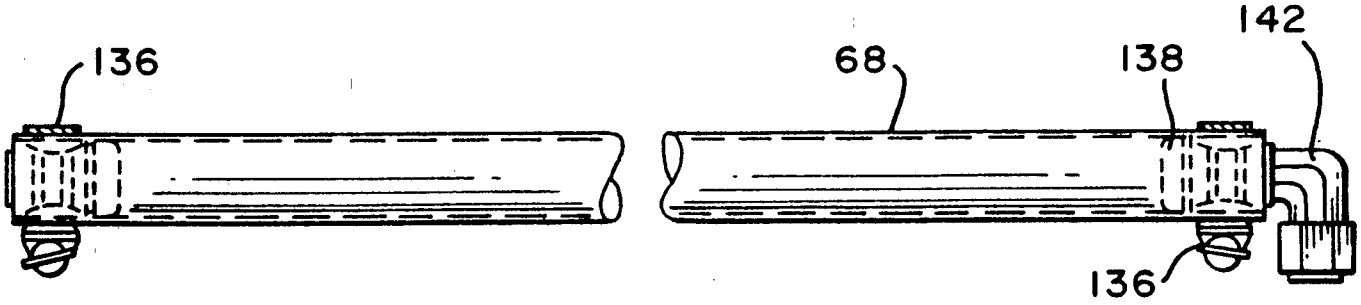
FIG. 6 is a side view of the air tube.
Figure 7:
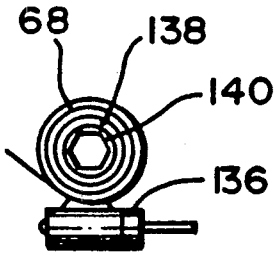
FIG. 7 is an end view of the air tube from the left side in FIG. 6.

FIG. 6 shows the elongated air tube 68, which preferably is made of a nylon weave fabric covered with plastic and lays flat when deflated. Each end of the tube 68 is clamped by a ring clamp 136 over a cylindrical metal boss 138 having a central bore (see also FIG. 7). The boss 138 at the left hand end of the tube 68 is closed by a screw plug 140 (FIG. 7), and a right angle connector 142 for an air line pipe is screwed into the right hand end boss.

Figure 8:
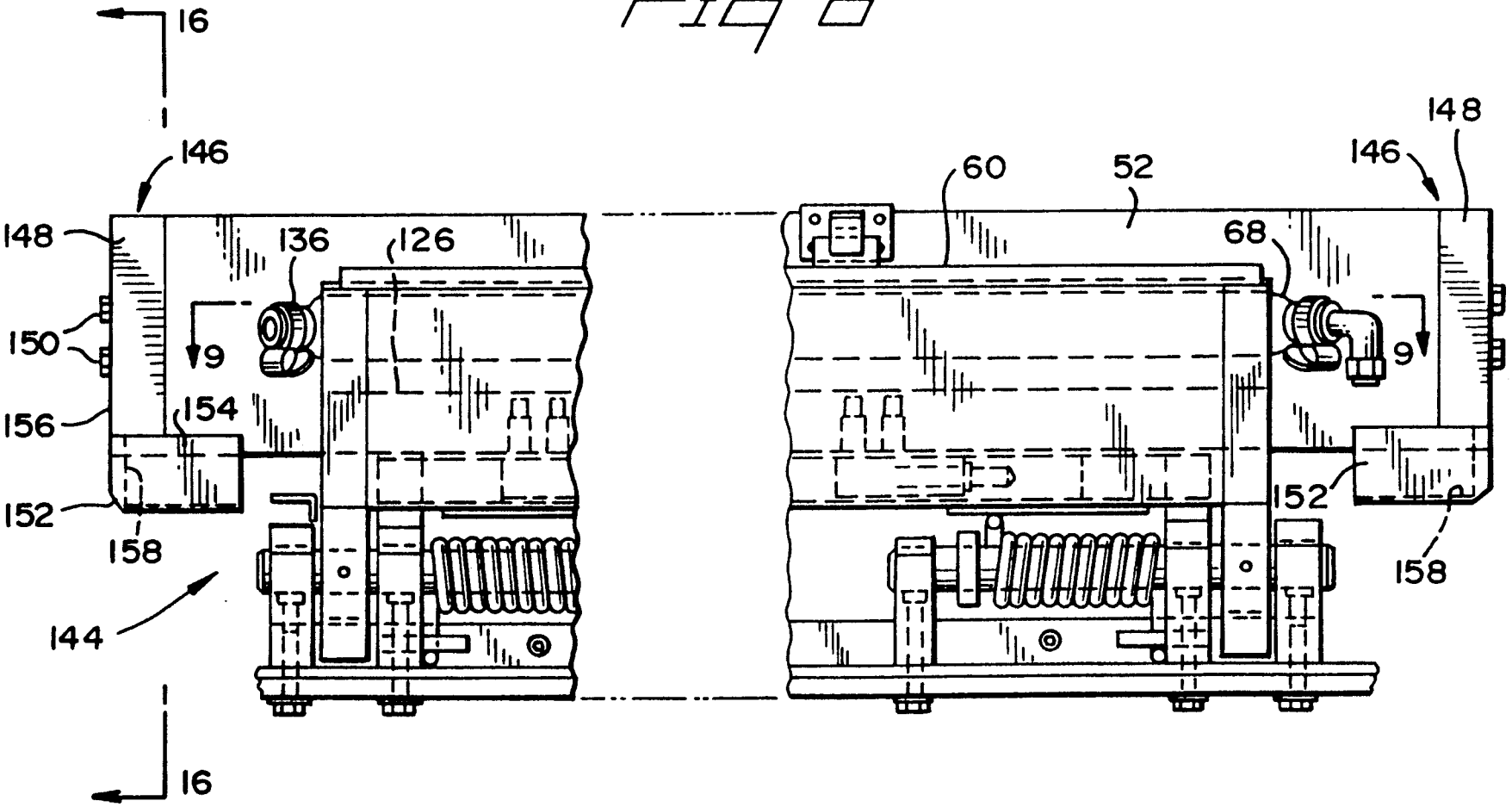
FIG. 8 is a view similar to FIG. 3, with some additional portions omitted for simplicity, of the preferred embodiment of the doctor blade head assembly of the invention.
Figure 9:
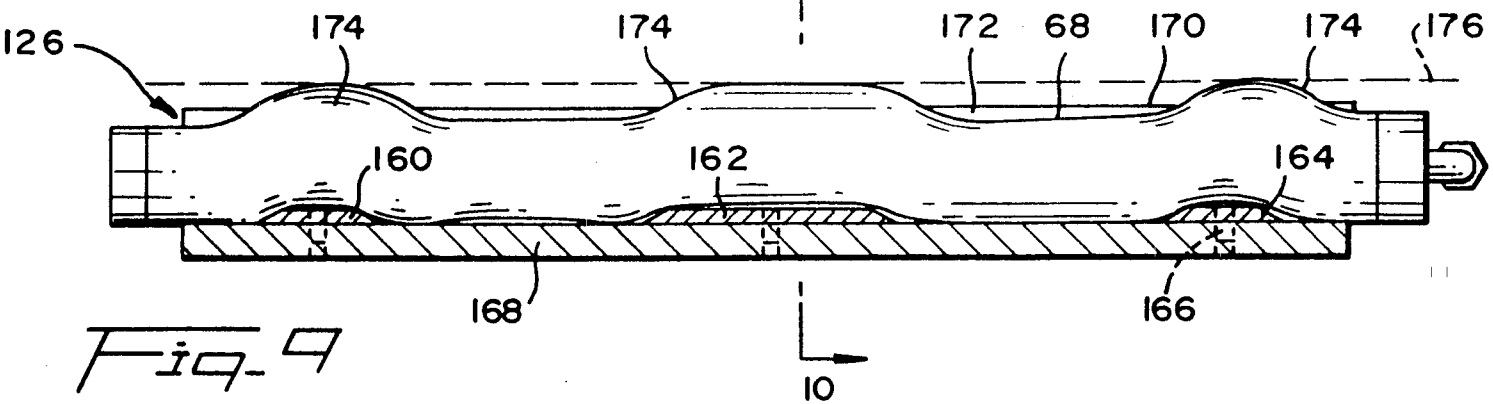
FIG. 9 is a simplified section on the line 9—9 in FIG. 8 showing the mounting and support of the air tube according to the invention.

FIG. 8 is a similar view to FIG. 3, and shows the preferred doctor blade head assembly 144 of the invention. The head assembly 144 is essentially the same as previously described with respect to FIG. 3, except for the mounting of the air tube 68 and the end seal arrangements 146 at each end of the doctor blade head body 52. Only these differences need be described As can be seen, the clamped ends, with the clamps 136, of the air tube 68 extend a short way past the ends of the backing and support frame 60. The channel 126, along the length of the body 52, is indicated by broken lines. Each end seal arrangement 146 includes an end plate 148 which is clamped by a pair of screws 150 against the respective end of the head body 52. A drip guard 152 is clamped by the same screws 150 to the outer side surface of this end plate 148. Each end plate 148 is disposed just outboard of the adjacent vertical end of the anilox roll 32 (FIG. 2), and the drip guard 152 forms a scoop which has a lower wall extending under the respective end plate and end of the head body 52 to direct ink exiting from the doctor blade head assembly into the drain tray 46 (FIG. 2). In end view, the portion of each drip guard 152 under the head body 52 would be positioned and extend similarly as the lower exit leg of the outlet pipe 56 as shown in FIG. 4—the two drip guards 152 taking the place of the two outlet pipes 56 previously described. It should be noted that each drip guard 152 has an upper and rear wall 154, a side wall 156, an inwardly turned front wall and an underneath bottom wall 158 which extends forwardly below the upper wall 154 and the head body 52. The ink inlet for the head assembly 144 is the same as that for the previously described head assembly 36.

FIG. 9 is a simplified section along the line 9—9 of FIG. 8 with the air tube 68 not being shown in section This could also be a similar section along the head embodiment of FIG. 3. Three riser plates 160, 162, 164 are rigidly secured by screws 166 to the bottom 168 of channel 126 (i.e. to the back wall of the channel against the frame 60 as viewed in FIG. 4). The riser plates 160, 164 are equal in size and disposed symmetrically a short distance inward from the ends of the channel bottom 168. The third riser plate 162 is longer than the plates 160, 164 and is disposed midway along the length of the channel bottom 168. The plates 160, 162, 164 are relatively thin and have ramped ends, each end ramp extending away from the channel bottom 168 at an acute angle of about 15 degrees. The air tube 68, when inflated, may be below the outer longitudinal edges 170 of side walls 172 of the channel 126. However, the portions of the air tube 68 that pass over the riser plates 160, 162, 164 are consequentially caused to bulge out beyond the side walls 172 of the channel 126. This can be clearly seen in FIG. 9 where three bulges 174 of the tube 68 protrude out of the channel 126 and engage against the back surface 176 (indicated as a broken line) of the doctor head body 52 (see also FIG. 5). Although not shown in FIG. 9, the flexible retainer strip 132 (FIG. 5) is deformed and sandwiched between these three bulges 174 and the surface 176. When the air tube 68 is deflated, the bulges 174 may retract into the channel below the channel wall edges 170.

FIG. 10 is a section on the line 10—10 of FIG. 9 and shows the central bulge 174 protruding beyond the outer edges 170 of the channel side walls 172. The central riser plate 162 causing this bulge can be seen extending across the full width of the bottom of the channel 126, as do the other riser plates 160, 164.

FIG. 11 shows in perspective view the riser plate 160, the riser plate 164 being identical and the longer riser plate 162 being similar The ramped ends 178, and a central hole 180 for the securing screw, can clearly be seen.

Figure 12:
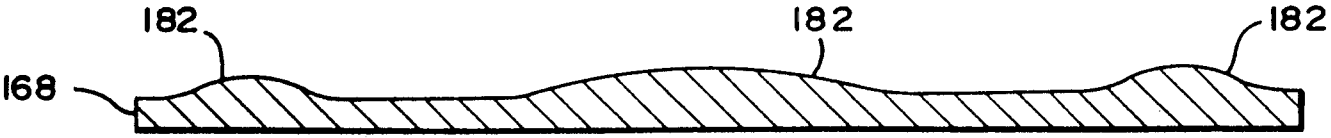
FIG. 12 is a view similar to FIG. 9 but showing only a modified base of the air tube channel.
Figure 13:
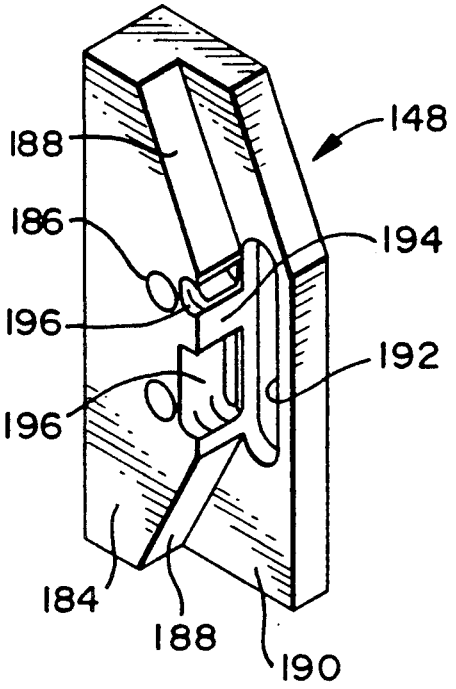
FIG. 13 is a perspective view of the seal plate at the left hand end of the doctor blade head in FIG. 8 looking at the side of the seal plate which abuts the body of doctor blade head.

FIG. 12 shows a modification of the channel bottom 168 in which the three riser plates of FIG. 11 are replaced by three risers integrally formed with the channel bottom. The channel bottom 168 is machined to form three mounds of curved profile to provide three integral risers 182 which function similarly to the risers 160, 162, 164 in FIG. 9.

FIG. 13 shows in perspective view the inner side of the lefthand end plate 148 in FIG. 8, the righthand end plate being the mirror image thereof An inner surface 184 is securely fastened, in liquid tight manner, to the respective end of the doctor blade body 52, with the screws 150 in FIG. 8 passing through bores 186. Angled shoulders 188 are contacted by and support the very end portions of the doctor blades. The ends of the doctor blade body 52 are the same shape and size as the surface 184. An outer end wall 190 protrudes beyond the shoulders 188 and contains a central elongated recess 192 having curved upper and lower ends. As will be readily realized, the outer end wall 190 is spaced outwardly from, and beyond, the adjacent vertical end surface of the doctor blade body 52 (FIG. 8) to which the inner surface 184 is secured. Between the angled shoulders 188 are machined two depression-like grooves 196 leaving a flat topped land 194 therebetween. This land 194 is coplanar with the rearward longitudinal side of the recess 192. As can be seen, the upper depression-like groove 196 is narrower than the lower groove 196, so displacing the land above the center of the end plate 148 and above the center of the longitudinal recess 192.

Figure 14:
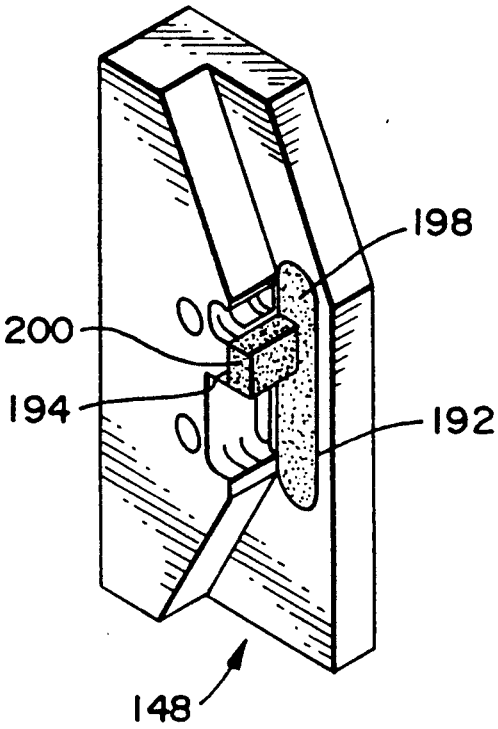
FIG. 14 is the same perspective view as FIG. 13 but with a resilient seal pad and a resilient seal block mounted in position on the seal plate.

FIG. 14 is the same view as FIG. 13, except a resilient seal 198 is inserted and glued in the recess 192, and a resilient seal 200 covers completely and is glued to the land 194. The seals are preferably formed of closed cell foam rubber. The seal 198 is a pad which protrudes very slightly (a few thousandths of an inch) proud of the inner surface of the outer end wall 190. The seal 200 is a block which completely, and exactly, fits the entire flat surface of the land 194. The block seal 200 extends only part way across the width of the pad seal 198 (as clearly shown in FIG. 14), but the outer end surface of the block seal abuts and seals against the inner proud face of the pad seal 198.

Figure 15:
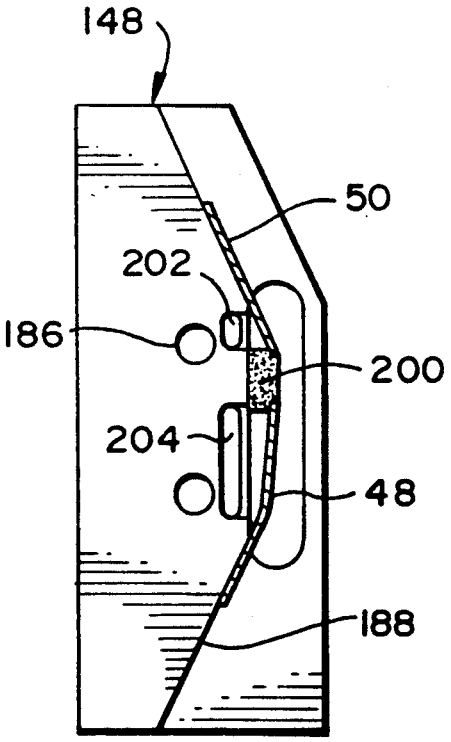
FIG. 15 is a diagrammatic side view of the seal plate and seals of FIG. 14 with the two doctor blades shown in position in section.

FIG. 15 shows the upper stiff doctor blade 50, and the longer and more flexible lower doctor blade 48, in their operative positions, both blades being shown in section. The free operative edges of the two blades can be seen slightly overlapping and depressing into the upper and lower portions of the outer surface of the block seal 200. In this way, the block seal 200 closes and seals the gap between the two doctor blades at the end location where the extreme ends of these blades extend axially past the ends of the anilox roll. The free operative edges of these blades also engage the anilox roll as illustrated in FIG. 4, except the lower blade 48 can now be seen flexed to provide somewhat more tangential contact with the upwardly rotating anilox roll. Also, the grooves 196 extend right through the end plate 148 as two spaced-apart apertures 202, 204, with the upper aperture 202 being smaller than the lower aperture 204. These apertures 202, 204 have a combined cross-sectional area of less than half the cross-sectional area of the single ink inlet aperture at the outlet of the ink inlet pipe 54 (FIGS. 2 and 3), and function as ink outlet apertures (two at each end of the doctor blade head).

Figure 16:
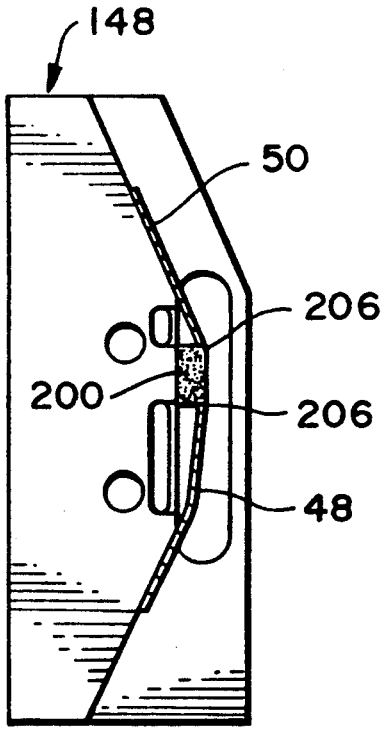
FIG. 16 is the same view as FIG. 15, but showing the preferred contact arrangement between the resilient seal block and the free edges of the doctor blades, this is a simplified sectional view on the line 16—16 of FIG. 8.

FIG. 16 is the same view as FIG. 15, but illustrating the preferred manner of adjusting and sealing the doctor blades 48, 50. As can be seen in FIG. 16, the doctor blades are adjusted so that the free and operative edges of the blades engage against the upper and lower side walls of the black seal 200. Further, the free edges of the doctor blades, to be sealed by the seal 200, are smeared with a non-water soluble grease, such as a lithium based grease as used in gear trains, bearings, etc. This grease layer is indicated by the reference numeral 206, and facilitates the free edges of the doctor blades sliding over and relative to the upper and lower surfaces of the block seal 200 as, in use, the doctor blades flex slightly. These grease layers 206 also complete and improve the liquid seal between the doctor blade edges and the block seal 200. It has been found that this preferred sealing arrangement mitigates solid particles, e.g. ink pigments, becoming trapped between the doctor blades and the seal 200, so minimizing any tendency for such particles to scratch and damage the sealing edges of the doctor blades.

A similar grease layer is smeared on the end, upright edges of the doctor blades where these somewhat upright edges engage the pad seals 198 (shown in FIG. 14 but omitted for clarity from FIGS. 15 and 16). This facilitates sliding of these upright end edges over the pad seals 198 as the doctor blades flex in use; it also improves the seal between these upright end edges and the respective seal 198 and minimizes abrasion of these upright end edges by ink particles, etc.

Figure 17:
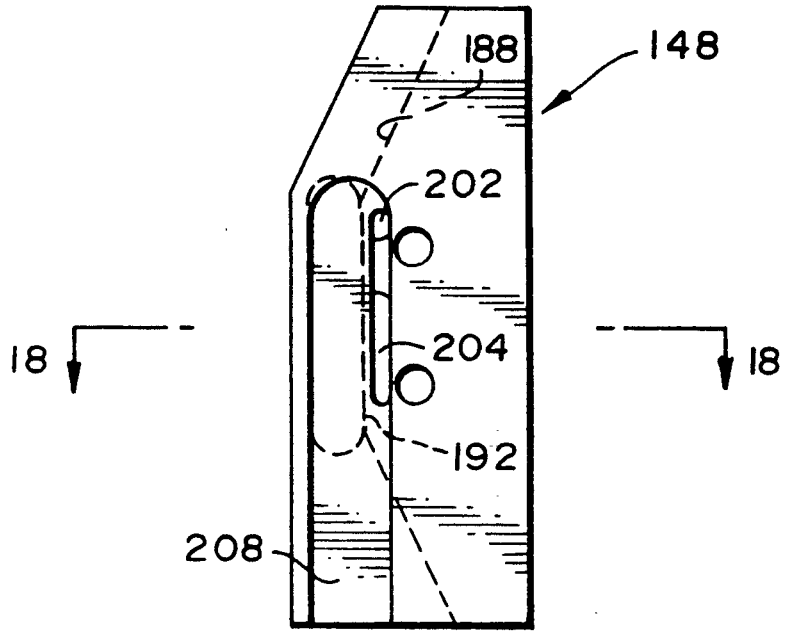
FIG. 17 is a side view of the seal plate of FIGS. 15 and 16 but taken from the opposite side and with the resilient seals omitted.
Figure 18:
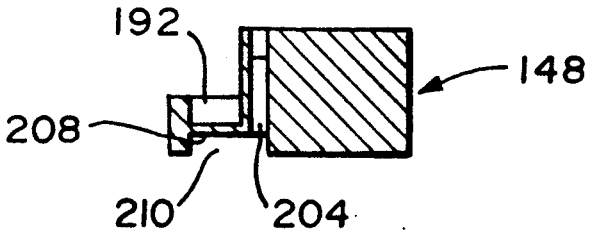
FIG. 18 is a cross-section on the line 18—18 of FIG. 17.

FIG. 17 shows the exterior side of the end plate 148, that is the opposite side to that shown in FIGS. 13 to 16. The recess 192, for the pad seal 198, is shown in broken lines, as are the angled shoulders 188. The through apertures 202, 204 are interconnected on the exterior side and open into a channel 208. This channel extends from its top, level with the top of the seal recess 192, to the bottom of the side plate 148 where the channel 208 is open. The apertures 202, 204 communicate with the channel 208 adjacent a rear side thereof and in the upper half thereof. The whole of the channel 208 is covered by the side wall 156 of the respective drip guard 152 (FIG. 8) secured to the exterior surface of the end plate 148. Thus, the channel 208 is completely closed except for an inlet via the apertures 202, 204 and an outlet at the lower edge of the side plate 148.

FIG. 18 is a section on the line 18—18 of FIG. 17 and shows the open lower end 210 of the channel 208. It also shows the lower aperture 204 and the seal recess 192.

In operation, ink enters the ink reservoir 116 (FIG. 4) between the doctor blades 48, 50, fills this ink reservoir, and the excess ink exits at each end of the doctor blade head via the respective pair of apertures 202, 204 and the downwardly extending channel 208 The ink exits through the downwardly facing open end 210 of each channel onto the respective drip guard 152 (FIG. 8) which directs this excess ink into the ink pan 46. As the total area of the ink outlets is less than the area of the ink inlet (via inlet pipe 54), the reservoir 116 in the doctor blade head is kept full of ink. The sliding grease seals at the edges of the doctor blades abutting the resilient seals 192 and 200, substantially eliminate deterioration of these edges and provide improved sealing of extended life. The intermittent bulges 174 (FIGS. 9 and 10) along the air tube 68 enable the doctor blade head to be engaged against the anilox roll with the required control to maintain a good liquid seal between the lower doctor blade 48 and the anilox roll; while the positioning of these bulges enables the doctor blade head to remain virtually perfectly straight along its length, so keeping the reversed angle doctor blade 50 perfectly straight along its length to provide improved uniformity of the doctoring function by this blade.

As will be appreciated, the features of FIGS. 9 through 18 provide a doctor blade head with improved doctoring, improved life of the end sealing, and virtual elimination of unwanted ink leakage By improving the control and uniformity of the doctored ink layer on the anilox roll in this manner, finer and improved quality printing can be achieved. Also, the elimination of ink leakage further enables improvement in quality, and facilitates better clean-up after printing.

The air pressure in the air tube 68 is preferably controlled during printing at a predetermined value in the range 15 to 40 pounds per square inch.

The number of air tube bulges 174 can be varied depending upon the length of the doctor blade head and the number of locations at which the head body 52 is hinged to the support frame 60 of the doctor blade head assembly 36. For example, there could be four bulges, or five bulges, or with a short doctor blade head only two bulges. With 80 inch, 113 inch and 123 inch wide flexographic printing sections, the three bulge arrangement of FIG. 9 with four hinge attachments between the head body of the support frame, has been found highly satisfactory, the head body and doctor blades being kept straight within a tolerance of 5 thousandths of an inch over their entire length The respective bulges 174 occurred between adjacent hinge attachments. The exact positioning of these bulges for optimum results is best finalized by trial and error.

With the 80 inch machine, the center riser plate 162 was 7 inch long, while the end riser plates 160, 164 were each 5.5 inches long and were centered 28 inches from the center of the head body. With both the 113 inch machine and the 123 inch machine, the center riser plate 162 was 10 inches long and the end riser plates 160, 164 each 5.5 inches long; however, with the 113 inch machine the end riser plates were each 29 inches off center, and with the 123 inch machine the end riser plates were each 34 inches off center. In all cases the ends of the riser plates were ramped upwardly at 15 degrees from the bottom of the air tube channel 126. Each riser plate was 0.35 inches in thickness (i.e. in height in FIGS. 9 and 10) between the ramped ends. The width of the riser plates across the channel 126 (as in FIG. 10) was 1.48 inches.

The above described embodiments, of course, are not to be construed as limiting the breadth of the present invention. Modifications, and other alternative constructions, will be apparent which are within the spirit and scope of the invention as defined in the appended claims.

For example, the doctor blade head could be employed in a glue applying machine.

Fluid other than air could be used to inflate the air tube, the expression air tube is intended to cover such use of other fluids.

The air tube could be supported on a shallowly curved concave surface extending substantially the full length of the head body, for example in the bottom of the tube support channel The end portions of the tube would then in effect form two bulges, one located at each end of the head body. In this case, however, the tube would be uniformly supported over the entire length of the shallowly curved concave surface, and would also tend to deform to contact the head body over the length thereof as the air tube is inflated and further pressurized. Turning to FIG. 9, this could be achieved by eliminating the center riser 162, and forming the end risers 160, 164 as one long riser plate having a concave upper surface extending symmetrically from the center to both ends with the shallowest portion of this long riser plate being at the center (where plate 162 is in FIG. 9). Such an arrangement would have two tube bulges 174 spaced apart along the channel 126, these bulges at the end portions of the tube protruding out of the channel 126; this protruding being caused by the lengthwise end portions of the channel being raised portions relative to the remaining central portion of the channel Thus, such an arrangement has two tube bulges, even though the tube would tend to deform to eventually try and contact the head body over the entire length of the tube as the inflation pressure was sufficiently increased.

Although in FIG. 9 the air tube 68 is shown recessed below the side walls of the channel 126 between the tube protrusions 174, this arrangement is not essential. It has been found convenient to allow the air tube between the tube bulges 174 to also extend out of the channel 126 and come into touching or light contact with the back wall 176 of the head body 52. By keeping the height of the riser plates 160, 162, 164 fairly small (e.g. 0.35 inch) and the air tube diameter relatively large (e.g. 1 to 2 inches), it has been found that the air tube can have kissing-like contact with the head body between the tube bulges 174, while the area of these tube bulges transmits the main force to the back wall of the head body at predetermined spaced locations The compression, or pinching, of the air tube between the riser plates and the back wall of the head body creates and positions the forces acting on the head body via the air tube. This kissing contact of the air tube between the tube bulges has become the preferred arrangement.

What is claimed is:

1. A doctor blade head assembly, comprising:

a head body having at least one doctor blade mounted thereon, said doctor blade extending in a lengthwise direction along said head body;

a support frame on which said head body is movably mounted;

an inflatable air tube disposed between said support frame and said head body, and extending in said lengthwise direction, said air tube urging said head body away from said support frame when said air tube is inflated; and said air tube when inflated having a plurality of bulges spaced apart along said lengthwise direction with said bulges acting upon said head body.

2. The doctor blade head assembly of claim 1, wherein said head body has opposite ends, and said plurality of bulges comprises a bulge located adjacent each of said opposite ends of said head body.

3. The doctor blade head assembly of claim 1, wherein said tube is supported in said support frame, and said tube only acts upon said head body via said bulges.

4. The doctor blade head assembly of claim 1, wherein said support frame has a channel therein, said tube is disposed in and extends along said channel, and said channel has a bottom formed with a plurality of raised portions.

5. The doctor blade head assembly of claim 1, including a flexible retainer mounted on said support frame and at least partially covering said air tube, said flexible retainer being sandwiched between said air tube and said head body when said air tube is inflated.

6. The doctor blade head assembly of claim 5, wherein said retainer comprises a strip extending in said lengthwise direction, said strip having a free edge also extending in said lengthwise direction, and said strip flexing to accommodate said bulges when said air tube is inflated.

7. The doctor blade head assembly of claim 4, wherein said raised portions comprise riser plates secured to said channel bottom.

8. The doctor blade head assembly of claim 7, wherein each said riser plate has a ramp at each end.

9. The doctor blade head assembly of claim 4, wherein each said raised portion has a ramp at each end inclined away from said channel bottom at an angle of 15 degrees.

10. The doctor blade head assembly of claim 9, wherein a flat portion connects the ramps at each end.

11. The doctor blade head assembly of claim 4, wherein said raised portions are integral with said channel bottom.

12. The doctor blade head assembly of claim 4, wherein said raised portions are formed by a curved surface.

13. The doctor blade head assembly of claim 4, wherein said air tube when deflated flattens against the bottom of said channel.

14. The doctor blade head assembly of claim 1, including a plurality of spaced apart hinged connections between said head body and said support frame, each of said bulges being disposed between two adjacent hinge connections.

15. The doctor blade head assembly of claim 1, wherein:

said head body has two doctor blades mounted thereon and defining a reservoir space therebetween;

said head body is pivotally attached to said frame structure to pivot about an axis parallel to said lengthwise direction;

means for resiliently urging said head body to pivot towards said air tube;

end plates mounted on said head body and closing said reservoir space at opposite ends of said head body;

an inlet in said head body for introducing liquid into said reservoir space; and an outlet passageway extending through each end plate for allowing exit of said liquid from said reservoir space.

16. The doctor blade head assembly of claim 1, wherein:

said head body has two doctor blades mounted thereon, said doctor blades converging towards each other transversely to said lengthwise direction;

free edges of said doctor blades in said lengthwise direction being spaced apart and having end portions smeared with grease;

a seal comprising a block of resilient material located at each end of said head body; and the greased end portions of said free edges slidably engaging against opposite side walls of the respective block.

17. The doctor blade head assembly of claim 1, wherein:

said head body has an end plate mounted thereon at each end in said lengthwise direction;

each end plate includes an outer end wall spaced outwardly away from the respective head body end;

each said outer end wall supports a resilient seal; and each doctor blade extends beyond each said head body end and abuts the respective seal.

18. The doctor blade head assembly of claim 1, wherein:

said head body has an end sealing plate at each end;

said doctor blade has a transverse edge at each end abutting the respective end sealing plate; and each said transverse edge has grease thereon which facilitates sliding of that edge on said end sealing plate.

19. The doctor blade head assembly of claim 18, wherein each said end sealing plate includes a resilient seal and the respective greased transverse edge engages said resilient seal.

20. A printing apparatus, comprising:

a machine frame;

an anilox roll rotatably supported in and extending in an axial direction across said machine frame;

a doctor blade head body having at least one doctor blade mounted thereon, said doctor blade extending in said axial direction along said head body;

a support frame on which said head body is movably mounted, said support frame being supported in said machine frame;

an inflatable air tube operative between said support frame and said head body, said air tube urging said head body towards said anilox roll when said air tube is inflated; and said air tube when inflated has a plurality of predetermined bulges spaced apart in said axial direction, said bulges acting upon said head body.

21. The printing apparatus of claim 20, wherein said tube extends in said axial direction, is supported in said support frame, and only acts upon said head body via said bulges.

22. The printing apparatus of claim 20, wherein said support frame has a channel therein, said tube is disposed in and extends along said channel, and said channel has a bottom formed with a plurality of raised portions which cause said air tube to form said bulges.

23. The printing apparatus of claim 20, wherein said doctor blade has end edges extending transversely to said axial direction at opposite ends of said doctor blade; and said head body has an end seal assembly at opposite ends in said axial direction, each end seal assembly comprising:

an end plate attached to said head body, a wall portion of said end plate being spaced from said head body and carrying a resilient seal;

said resilient seal engaging a respective one of said end edges of the doctor blade; and an ink outlet passageway extending through the end plate.

24. The printing apparatus of claim 20, wherein:

said head body has two doctor blades mounted thereon and defining an ink reservoir therebetween;

free edges of said doctor blades in said axial direction being spaced apart, end portions of these edges having grease thereon;

resilient blocks located at opposite ends of said head body; and the greased end portions of said edges slidably engaging side walls of said blocks.

25. A doctor blade head assembly, comprising:

an elongate head body having two doctor blades mounted thereon and defining an ink reservoir therebetween, said doctor blades extending in a lengthwise direction;

end seal assemblies mounted on opposite ends of said head body to provide ends for said ink reservoir;

a support frame on which said head body is mounted to pivot about an axis parallel to said lengthwise direction;

a channel extending along said support frame in said lengthwise direction, said channel having a bottom formed with a plurality of rigid raised portions spaced apart in said lengthwise direction;

an elongate inflatable air tube disposed in and extending along said channel over said raised portions, said air tube being disposed adjacent said head body and when inflated being forced against said head body at spaced apart locations where said air tube extends over said raised portions;

means biasing said head body to pivot towards said air tube; and said air tube when inflated acting upon said head body to pivot said head body in a direction away from said air tube, said air tube essentially acting upon said head body only at said spaced apart locations to mitigate bending of said head body by said elongate inflated air tube.

26. The doctor blade head assembly of claim 25, wherein each of said end seal assemblies comprises:

an end plate attached to said head body with a wall portion of the end plate being spaced from said head body and carrying a first resilient seal, this seal also being spaced from said head body and being engaged by end edges of the doctor blades;

a second resilient seal mounted on said end plate and extending in said lengthwise direction from said first resilient seal to said head body, portions of lengthwise edges of said doctor blades engaging opposite sides of said second resilient seal; and an ink outlet passageway extending through said end plate to allow ink to discharge from said ink reservoir through said end plate.

27. The doctor blade head assembly of claim 25, wherein said plurality of raised portions is formed by three raised portions, one of the raised portions being at the center of said channel in said lengthwise direction, and the other two raised portions being equally spaced from the center raised portion on opposite sides thereof.

28. The doctor blade head assembly of claim 27, wherein said other two raised portions are of equal length in said lengthwise direction, and said center raised portion is longer than each of said other two raised portions.

* * * * *